US005233659A

United States Patent [19]

Ahlberg

[11] Patent Number: 5,233,659

[45] Date of Patent: Aug. 3, 1993

[54] METHOD OF QUANTIZING LINE SPECTRAL FREQUENCIES WHEN CALCULATING FILTER PARAMETERS IN A SPEECH CODER

[75] Inventor: Jonas T. Ahlberg, Stockholm, Sweden

[73] Assignee: Telefonaktiebolaget L M Ericsson, Stockholm, Sweden

[21] Appl. No.: 816,970

[22] Filed: Jan. 3, 1992

[30] Foreign Application Priority Data

Jan. 14, 1991 [SE] Sweden ..... 9100116

[51] Int. Cl.[5] ..... G10L 3/02; G10L 5/00

[52] U.S. Cl. ..... 381/30; 381/31; 381/36

[58] Field of Search ..... 381/30, 31, 36, 37, 381/47, 42, 39

[56] References Cited

U.S. PATENT DOCUMENTS

| | | | |
|---|---|---|---|
| 3,624,302 | 11/1971 | Atal | 179/1 SA |
| 3,740,476 | 6/1973 | Atal | 179/1 SA |
| 4,393,272 | 7/1983 | Itakura et al. | 381/39 |
| 4,472,832 | 9/1984 | Atal et al. | 381/40 |
| 4,975,955 | 12/1990 | Taguchi | 381/36 |
| 4,975,956 | 12/1990 | Liu et al. | 381/36 |
| 5,012,518 | 4/1991 | Liu et al. | 381/42 |
| 5,086,471 | 2/1992 | Tanaka et al. | 381/36 |

FOREIGN PATENT DOCUMENTS

WO91/02348 2/1991 PCT Int'l Appl. .

OTHER PUBLICATIONS

P. Kabal et al., "The Computation of Line Spectral Frequencies Using Chebyshev Polynomials," IEEE Transactions on Acoustics, Speech, and Signal Processing, vol. ASSP-34, No. 6, Dec. 1986.

*Primary Examiner*—Dale M. Shaw
*Assistant Examiner*—Kee M. Tung
*Attorney, Agent, or Firm*—Burns, Doane, Swecker & Mathis

[57] ABSTRACT

A method of quantizing the line spectral frequencies (LSF) when calculating the parameters of an analysis filter is included in a linear predictive coding (LPC) speech coder. The line spectral frequencies form an alternative to the filter parameters with unambiguous correspondence. Sum polynomials (P) and difference polynomials (Q) are constructed from the direct form coefficients of filters. Thereafter, the roots of the polynomials which correspond to the line spectral frequencies are determined, without calculation, by examining the polynomials in light of pre-selected test frequencies ($f_{tp1}$, $f_{tqf1}$, $f_{tp2}$, $f_{tq2}$, . . . ) that are speech typical. The polarity of the two polynomials (P, Q) is investigated for each of these test frequencies. When a polarity change occurs between two test frequencies, one of these frequencies, such as the higher frequency, is chosen. The chosen frequency gives a given root (p1 and q1 respectively) of the respective sum and difference polynomial (P and Q), and therewith a line spectral frequency (LSF1 and LSF2 respectively).

10 Claims, 4 Drawing Sheets

Fig. 1
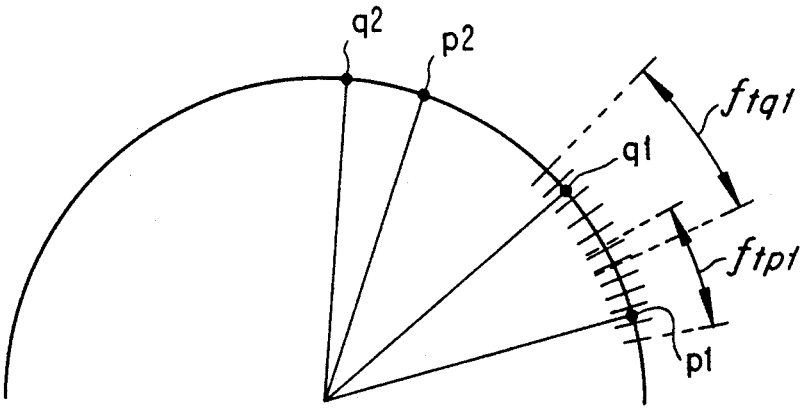
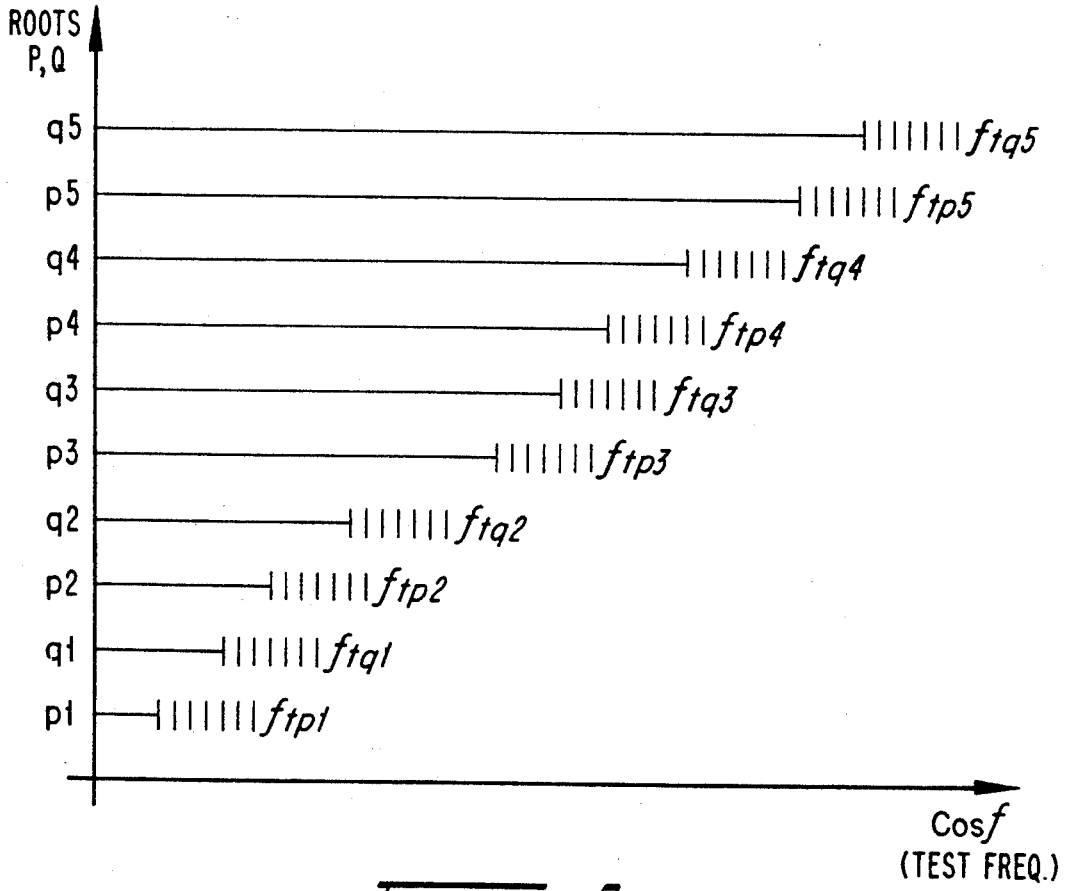
Fig. 2

Fig. 4
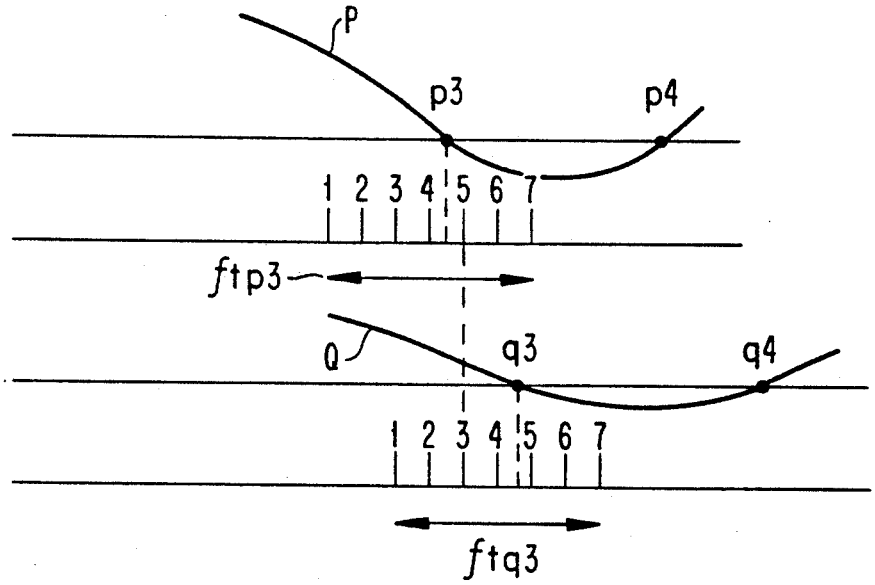
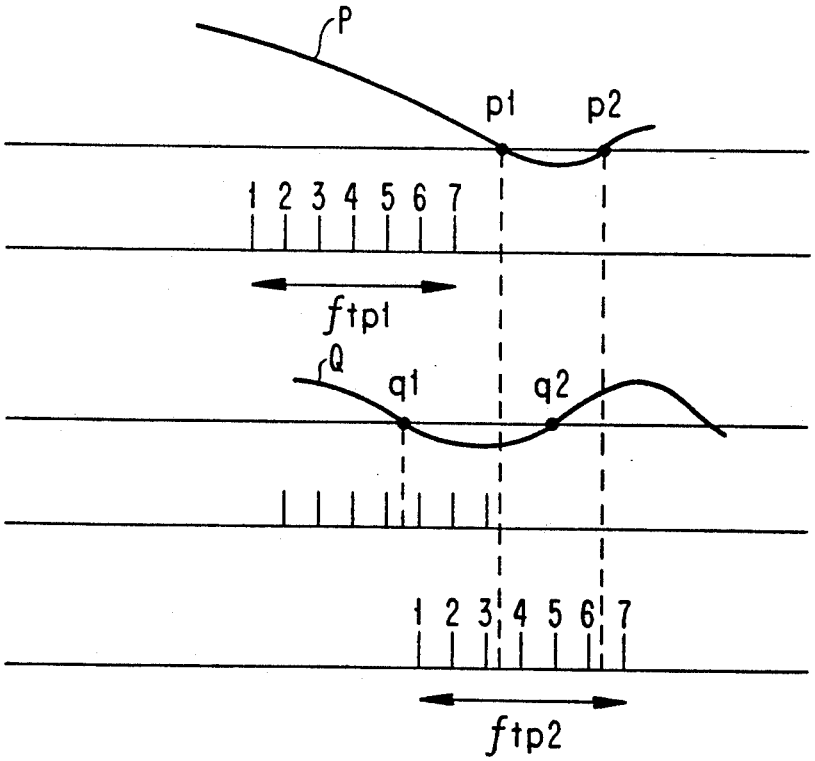
Fig. 5

METHOD OF QUANTIZING LINE SPECTRAL FREQUENCIES WHEN CALCULATING FILTER PARAMETERS IN A SPEECH CODER

TECHNICAL FIELD

The present invention relates to a method of quantizing line spectral frequencies (LSF) when calculating the parameters of an analysis filter included in a speech coder. The analysis filter is used, together with a corresponding synthesis filter in the coder, for linear predictive coding of incoming speech signals.

BACKGROUND ART

A speech coder for use, for instance, in mobile radio technology includes a linear predictive coder for coding speech signals with the intention of compressing the speech signals and reducing the redundance normally found in human speech. Speech coders which operate with linear predictive coding are known to the art and are found and described and illustrated, for instance, in U.S. Pat. No. 3,624,302, U.S. Pat. No. 3,740,476 and U.S. Pat. No. 4,472,832. This latter patent specification also describes the use of excitation pulses when forming the synthetic speech copy.

The function of the analysis filter in speech coders is to analyze the incoming speech (in the form of speech samples) and determine the filter parameters that shall be transmitted and transferred to the receiver, together with certain so-called rest signals. The excitation pulses to be used can also be transmitted in the manner described in U.S. Pat. No. 4,472,832. Data relating to filter parameters, rest signals and excitation pulse parameters is transmitted in order to be able to transmit on narrower bands than those required to transmit the actual speech signals (modulated).

The filter parameters, which are often called direct form coefficients, are used in the synthesis filter on the receiver side to predict the transmitted speech signal linearly and to form a synthetic speech signal which resembles the original speech signal as far as is possible.

The use of so-called line spectral frequencies (LSFs) for coding the direct form coefficients, i.e. the filter parameters, when coding speech signals linear predictively has earlier been proposed; see for instance "The Computation of Line Spectral Frequencies Using Chebyshev Polynomials", IEEE Transactions on Acoustics, Speech and Signal Processing, Vol. ASSP 34, No. 6, December 1986, pages 1419–1425. In this case, the line spectral frequencies are an alternative to the filter parameters with unambiguous correspondence. The primary advantage afforded by coding the direct form coefficients is that the LSFs directly correspond to the formant frequencies from the oral cavity and can thus be quantized advantageously prior to being transmitted and transferred to the receiver.

As described in the aforesaid article, a sum polynomial and a difference polynomial are formed when converting to line spectral frequencies from the direct form coefficients. Subsequent to having constructed these two polynomials, the roots of the polynomials are calculated and thereafter quantized. The number of roots to be localized and calculated vary with the mathematical order of the LPC-analysis. A 10th order LPC-analysis, which is typical, gives five (5) roots with each polynomial.

The normal calculating procedure, which is described in the aforesaid reference, involves localizing the roots by means of iteration, for instance in accordance with the so-called Newton-Rapson method. Subsequent to having calculated the roots, the roots are quantized and the quantized values are transmitted to the receiver side as filter parameters.

DISCLOSURE OF THE INVENTION

The problem with using line spectral frequencies LSF in accordance with the aforegoing, in spite of the advantages mentioned, is the necessity of calculating or localizing the roots of two polynomials. This may involve complicated calculations and thereby lower the speed of the speech coder. The known methods of obtaining the values of the line spectral frequencies in quantized form by calculation do not utilize the properties possessed by these sum and difference polynomials:

a) If the filter which is to be represented by the LSFs is stable, the roots occur at increasing frequencies, alternating from the sum polynomial and from the difference polynomial respectively.

b) Because the spectrum which the filter attempts to represent derives from a speech signal, the roots will not lie closer together than a given frequency. This is because the spectrum lacks sharp peaks and because of the physical properties of the tone-forming organs (the oral cavity).

The known method of calculating the roots of the aforesaid two polynomials involves unnecessary accuracy in localizing the roots, since a) these roots shall nevertheless be quantized and therewith loose their precision;

b) it is necessary to localize the roots much more accurately in order to know on which side of the quantizing border a root is located. If this is not known, it cannot be certain that the root has been quantized to the proper quantizing level.

Other drawbacks and problems associated with the known method are:

It may be necessary to evaluate the polynomial for a large number of different frequencies. Sometimes there is no prior knowledge of the frequencies for which this evaluation must be made.

When evaluating the polynomial, it is necessary to calculate the cosine of the tested frequency. (It is conceivable, however, that certain methods are found which effect the Newton-Rapson iteration direct on the X-axis, i.e. in the cos-domain).

With each root discovered, it is necessary to divide the polynomial by this root, in order that the root is not again "found" in the next iteration.

In some of the methods similar to the Newton-Rapson method, it can not be absolutely certain that the roots are found in the correct order. It is therefore necessary to sort out these roots prior to quantizing.

Subsequent to quantizing, it is not absolutely certain that the monotonicity remains for the LSFs. These LSFs may, after all, have been "cross-quantized". Although this is improbable, it may nevertheless occur, particularly when the choice of quantizing tables is an unfortunate one. It is therefore necessary to postcheck and adjust the quantizing values.

When practicing the present, inventive method, the sum and difference polynomials are evaluated solely for given frequencies that are pre-selected from a limited number of frequencies. According to the proposed method, no calculations are carried out in respect of the polynomials, for instance iteration, as required by the known method, and instead the polynomials are evaluated and quantized on the basis of a number of initially decided, speech-typical frequencies. This enables the polynomials to be evaluated in a rising order, i.e. the polynomials are first examined for low frequencies and thereafter for successively increasing frequencies with the intention of establishing the roots of the polynomials. It is also possible, however, to evaluate the polynomials in a falling order, or to begin from respective directions and meet in the middle of the chosen frequency values.

The pre-selected frequencies are calculated on the basis of the formants characteristic of human speech and are appropriately stored in a memory store so as to be available during the actual evaluation of the polynomials.

The object of the present invention is to provide a method for evaluating, i.e. finding the roots of the sum and difference polynomials used to transmit the prediction coefficients for the synthesis filter in a speech coder, without needing to make complicated calculations, wherein the line spectral frequencies of the speech are obtained in quantized form.

The inventive method is characterized by the characteristic features set forth in the characterizing clause of claim 1.

BRIEF DESCRIPTION OF THE DRAWINGS

The inventive method will now be described in more detail with reference to the accompanying drawings.

FIG. 1 is a diagram which illustrates the roots of the polynomials and the position of given test frequencies used in the inventive method;

FIG. 2 is a diagram which illustrates in more detail the frequency position of the different test frequencies in relation to the roots of the polynomials;

FIGS. 4 and 5 are more detailed diagrams of specific cases when applying the inventive method.

BEST MODE OF CARRYING OUT THE INVENTION

Figure 3:
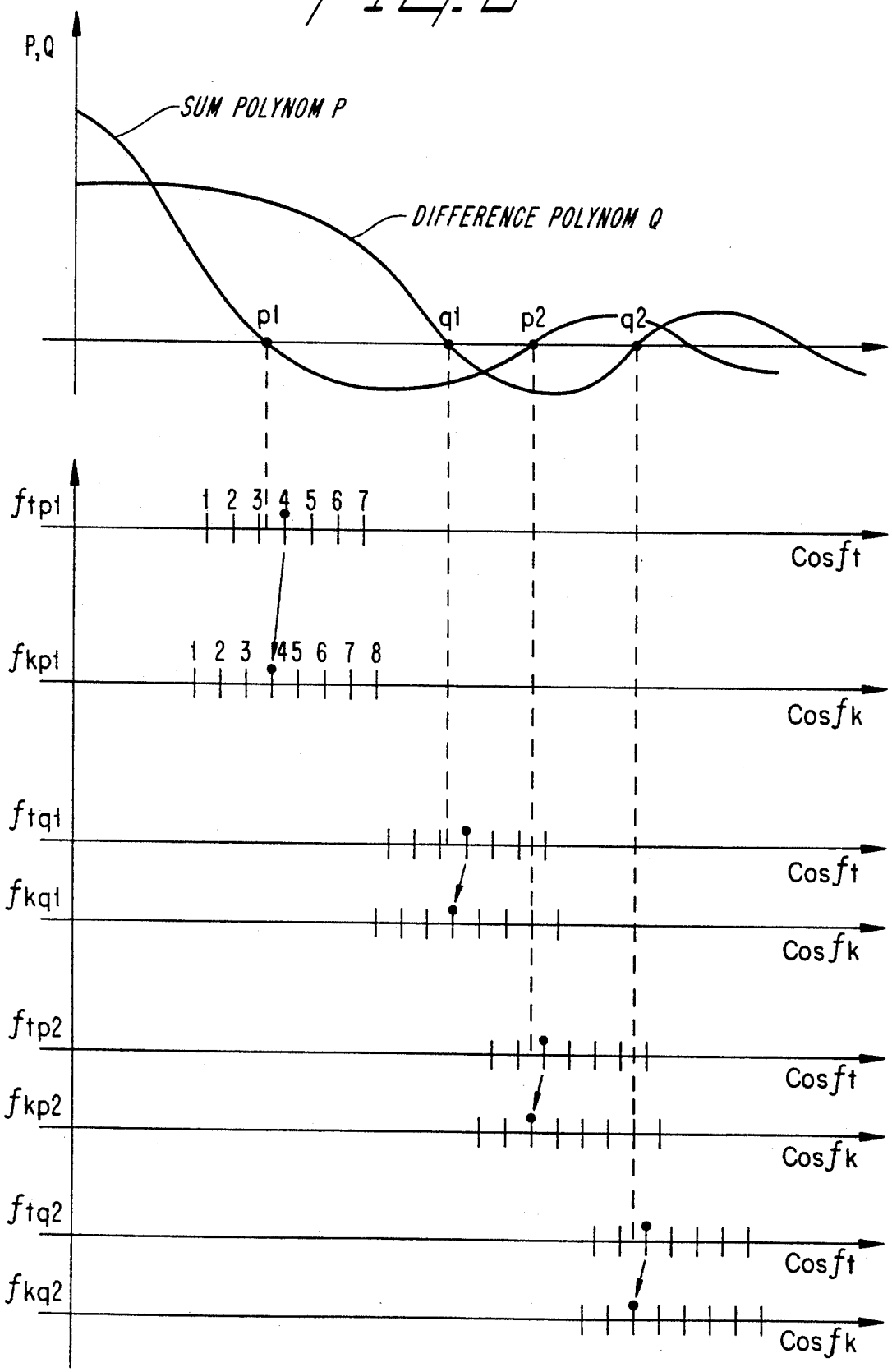
FIG. 3 is a diagram which shows the sum polynomial and the difference polynomial and illustrates how the roots are scanned and sought when applying the inventive method.

The inventive method is applied on a linear predictive coder of a known kind described, for instance, in the aforesaid U.S. patent specifications. A coder of this kind carries out a so-called LPC-analysis on incoming speech signals (in sampled form). The LPC-analysis first involves the formation of the so-called direct form coefficients, whereafter the coefficients are quantified and transmitted as an LPC-code. The direct form coefficients $a_k$ are obtained by equalizing and forming mean values (Hamming analysis) and then estimating the autocorrelation function. Subsequent to this analysis stage, recursion calculations are carried out in order to obtain the reflexion coefficients with the aid of a so-called Schur algorithm, whereafter the reflexion coefficients are converted to the direct form coefficients by means of a stepping-up process. The aforesaid analysis steps are carried out in a signal processor of a generally known kind and with the aid of associated software. The inventive method may also be carried out in the same signal processor, as described below.

When practicing earlier known methods, the direct form coefficients $a_k$, obtained in accordance with the aforegoing, are either quantized directly prior to being transmitted over the radio medium, or the sum and difference polynomials mentioned in the introduction are formed and the roots of these polynomials calculated and quantified as described in the aforesaid IEEE article.

The roots of the sum and difference polynomials are not calculated when practicing the present invention. Instead, the cosine of a number of test frequencies belonging to each of the roots of the sum and difference polynomials P and Q respectively and associated quantizing frequencies are stored in a fixed memory in the signal processor.

FIG. 1 illustrates the upper half of a unit circle. The P and Q roots of the two polynomials are located alternately on the unit circle. Only two roots p1 and p2 of each polynomial are shown, these roots constituting the roots of the sum polynomial P and the roots q1, q2 which constitute the roots of the difference polynomial Q. When practicing the inventive method, five (5) roots are investigated from each polynomial, resulting in a total of 10 line spectral frequencies for a 10th order synthesis filter.

A number of test frequencies are calculated for each of the five (5) roots in P and Q and the cosine values of these frequencies are stored in the fixed memory of the signal processor. FIG. 1 illustrates the position of seven (7) such test frequencies for each of the illustrated roots p1 and q1. Correspondingly, seven (7) test frequencies for instance are given for remaining roots p2, q2, p3, q3, and so on. For the sake of clarity, only the test frequencies for the roots p1 and q1 are shown, in the form of dashes around respective root positions on the unit circle, these test frequencies being referenced ftp1 and ftq1 respectively. As shown in FIG. 1, the regions for the test frequencies ftp1 and ftq1 overlap one another. FIG. 2 illustrates schematically the different groups of test frequencies for the roots pl, q1, p2, q2, p3, q3, p4, q4, p5, q5, these roots being stored in the memory of the signal processor.

As will be seen from FIG. 1, the roots of the two polynomials P and Q always alternate on the unit circle, i.e. each root from the sum polynomial P alternates with each root from the difference polynomial Q. Furthermore, the roots will never lie closer together than a given frequency, this frequency being dependent on the properties of the speech signal.

The aforesaid frequency properties, together with the choice of quantizing step (described below) are utilized in the method according to the present invention. The choice of quantizing steps also means that there cannot be found more than one root (or possibly one root for each polynomial) between each quantizing step. Three roots can never be found between each quantizing step. This means that it is known for certain that precisely one root is found between two points on the frequency axis where the sum polynomial or the difference polynomial has different signs. The method will now be described with reference to FIG. 3.

Shown at the top of FIG. 3 are the two polynomials P and Q with the roots p1, q1, p2, q2, and so on occurring alternately, as described above. Each line spectral frequency LSF (1–10) can be quantized to a given number of frequencies. From the group ftp1 of test frequencies for the root p1, there is taken the cosine for each of these test frequencies, beginning from the lowest "frequency 1" and the sign of the polynomial P for this test frequency is investigated. The sign is clearly positive for the test frequencies 1, 2 and 3 for the polynomial P shown in FIG. 3.

When testing with test frequency 4 in the group $f_{tp1}$, the polynomial p obtains a negative sign, thereby indicating that the polynomial has a root p1 which is located somewhere between the value of the test frequency 3 and 4.

A number of quantizing frequencies $f_{kp1}$ for the root p1 and $f_{kq1}$ for the root q1, and so on, are found for each of the test frequencies $f_{tp1}$. Each of the quantizing frequencies of a number of quantizing frequencies, for instance the number $f_{kp1}$, is located midway between two test frequencies. This is not a necessary condition, however. When determining the root p1 in the above case, the next quantizing frequency which is located immediately beneath the test frequency concerned (test frequency 4) is selected, i.e. the quantizing frequency 4 is selected.

The polynomial Q is then evaluated in the same manner as the polynomial P is evaluated, by inserting the cosine value of a number of test frequencies $f_{tq1}$, starting with the test frequency 1. As in the earlier case, the quantizing frequency immediately below this test frequency is chosen, in this case the quantizing frequency 4.

The polynomials P and Q are evaluated continually in a corresponding manner until the quantized values of all five (5) roots of each polynomial have been determined.

The aforesaid describes a normal quantizing of all $5+5=10$ roots of the polynomials P and Q, and the quantizing LSFs obtained are thus used as speech signal parameters in the one speech coder (the transmitter side) and are also transmitted to the speech coder of the receiver side in a known manner.

When investigating the roots of the polynomials P and Q, it is possible, however, that certain limitations and special cases arise, these limitations and special cases being shown in FIGS. 4 and 5.

FIG. 4 illustrates that part of the quantizing process in which he roots p3 and q3 shall be quantized. In this case, the cosine of the test frequencies 1 and 2 in $f_{tq3}$ is larger than the cosine of the frequency which corresponds to the root p3. In this case, the test frequencies 1 and 2 in $f_{tq3}$ may coincide with the test frequencies 3 and 4 in $f_{tp3}$. All such frequencies, i.e. the test frequencies 1 and 2 in $f_{tq3}$, which are smaller than the frequency to which the previous LSF, i.e. the root p3, was quantized to can be skipped over or eliminated when seeking the next LSF, i.e. the LSF which corresponds to the root q3.

FIG. 5 illustrates another case, namely a case in which the number of test frequencies is insufficient when seeking a root. As shown in FIG. 5, there is no change in sign in polynomial P for any of the tested test frequencies 1–7 in $f_{tp1}$ when seeking the root p1. Subsequent to having tested all test frequencies 1–7 without the occurrence of a change in sign, the last test frequency 7 is selected but a correspondingly higher quantizing frequency is selected (the quantizing frequency 8 instead of the earlier quantizing frequency 7 that is chosen in accordance with the FIG. 3 embodiment).

The fact that the root p1 is located beyond the last test frequency 7 in FIG. 5 results in the possibility of a sign change for this root p1 when seeking the next root p2 in the polynomial P. As shown in FIG. 5, a sign change (erroneous) is obtained for the test frequency 4 in $f_{tp2}$ when seeking the root p2. Consequently, a warning instruction is inserted in the signal processor when seeking a given root when no change in sign has taken place when seeking a preceding root. As will be seen from FIG. 5, the test frequency 7 in $f_{tp2}$ and corresponding quantizing frequency are taken as a measurement of the root p2.

Figure 6:
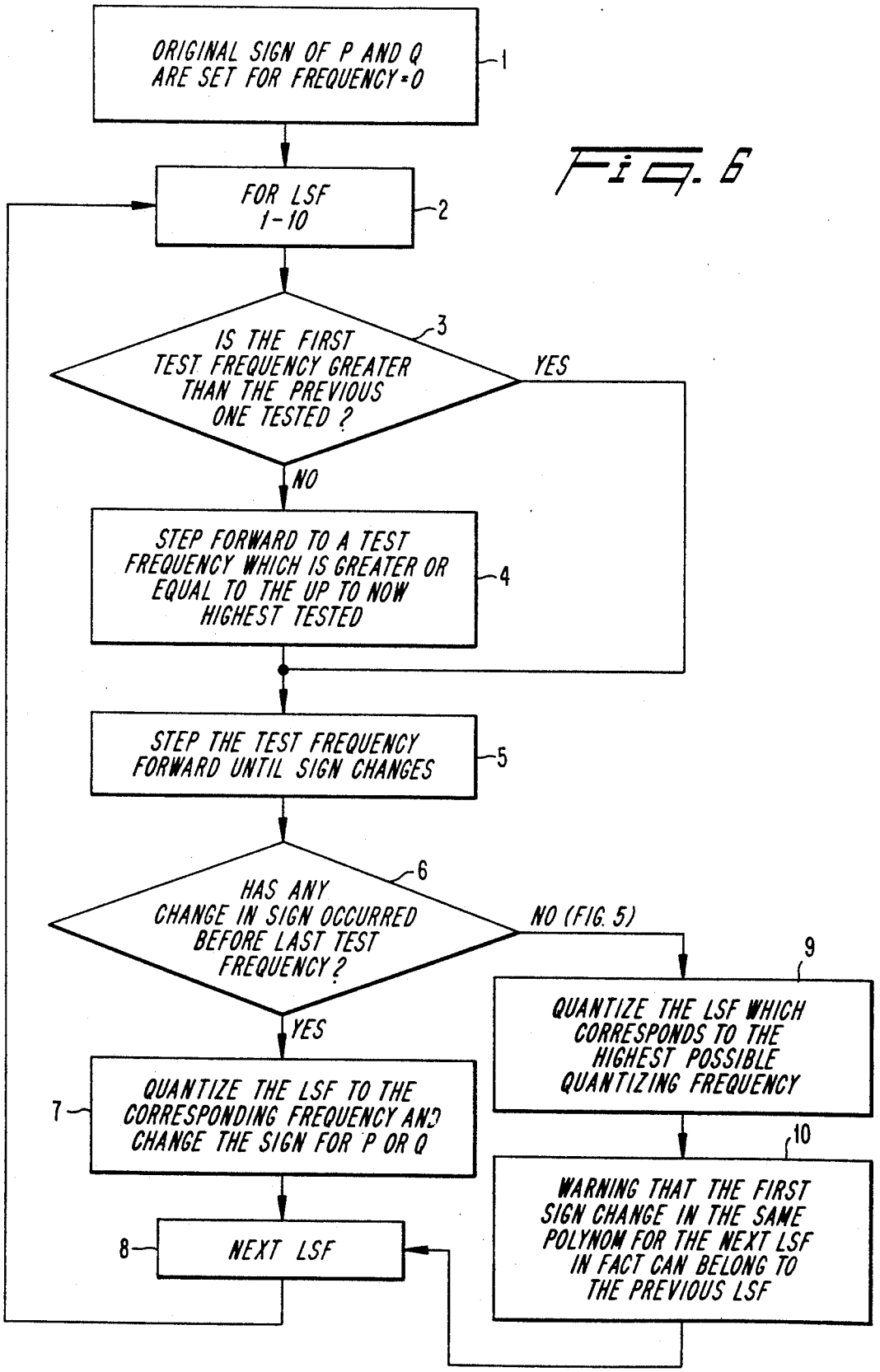
FIG. 6 is a flowchart illustrating the various steps of the inventive method.

FIG. 6 is a flowchart which illustrates scanning of the polynomials P and Q when practicing the proposed, inventive method.

Firstly, the polarity of the two polynomials P and Q for the frequency 0 Hz is established, see block 1, in order to obtain the polarity which shall later be used as a comparison when seeking the first root p1 in the polynomial P with the aid of the first group of test frequency values $f_{tp1}$ and when seeking the first root q1 in the polynomial Q with the aid of the second group of test frequency values $f_{tq1}$. Seeking of the first line spectral frequency LSF1 (c.f. FIG. 4) is then commenced, in accordance with block 2 in FIG. 6.

According to block 3, an investigation is made to ascertain whether or not the first test frequency 1 in each group of test frequencies is higher than the test frequency earlier tested. In the case of LSF1, the answer is always "Yes" and testing and forward stepping of the test frequencies 1,2, . . . for a given group is carried out, block 5. In the case of LSF2 and following LSFs, it is possible that the test frequency 1 and any following frequency will not have a higher value than the earlier tested frequency, "No", and forward stepping is effected in accordance with block 4, c.f. FIG. 4.

Block 6 involves an investigation for the purpose of obtaining information as to whether or not the case according to FIG. 5 (uppermost) has occurred, i.e. the case when the test frequencies are insufficient in number, "No". The change in sign has occurred in the normal case "Yes" and the LSF examined has been quantized to a corresponding quantizing frequency and the sign which the polynomial possessed subsequent to this change in sign is stored so as to be available when next seeking an LSF for this polynomial. Seeking of the LSF for the next polynomial is then carried out, i.e. if the polynomial P is investigated, the polynomial Q is now investigated, block 8. The next line spectral frequency LSF2 is thus obtained when evaluating the polynomial Q when seeking the quantizing frequency for the root q1, and LSF3 is obtained when seeking the quantizing frequency for the root p2, and so on.

When no sign change occurs ("No" in block 6), the LSF is quantized to the highest possible quantizing frequency, block 9. There is then stored a warning, block 10, that the LSF next found for the same polynomial may be the LSF that should actually have been found in a preceding search, but which is therewith "approximated" with the quantizing frequency belonging to the highest test frequency.

The investigation illustrated in the flowsheet is thus carried out alternately for the polynomials P and Q, wherein the positions of the alternating roots and associated LSFs are quantized as described above with reference to FIGS. 3–5.

What is claimed is:

1. A method of generating quantized line spectral frequency signals from incoming speech samples when calculating parameters for an analysis filter included in a speech coder in linear predicted coding of the incoming speech samples with the intention of synthesizing said samples in a speech decoder subsequent to transmitting the line spectral frequency signals over a transmission channel having limited transmission capacity, wherein the line spectral frequency signals are formed by constructing, based on the incoming speech samples, two mutually symmetrical polynomials for the analysis filter with alternating roots on a unit circle, and quantizing the roots obtained from said two polynomials and corresponding to the line spectral frequencies, comprising the steps of:

storing, in a memory store, a number of quantizing levels which correspond to pre-calculated line spectral frequencies;

seeking or scanning alternately on each of said polynomials, using a given number of test frequency values derived from said quantizing levels, to establish a polarity of each of the polynomials and determine a polarity change between two mutually sequential test frequency values for one and the same polynomial, the quantizing level which corresponds to the value between said two mutually sequential test frequency values then being chosen as a quantized line spectral frequency signal, wherein the chosen quantizing level lies midway between two consecutive test frequency values.

2. A method according to claim 1, further comprising the steps of combining test frequencies into groups of test frequencies with a given number of test frequencies in each group; and using the test frequency values belonging to a given group to test the polarity and to seek a given root of a given polynomial in order to determine the test frequency value for which a change in polarity has occurred and an associated quantizing level, which therewith gives a position of the root of the polynomial and therewith a specific quantized line spectral frequency signal.

3. A method according to claim 1, further comprising the step of choosing a largest quantizing value as a measurement of the root of a given polynomial when a polarity change of the given polynomial occurs for the largest test frequency value in a given group.

4. A method according to claim 3, further comprising the step of, when seeking a root which next follows a first said root for the same polynomial, taking into account the fact that the next following root can be misinterpreted as the first said root by ignoring a first occurring test frequency value for polarity change.

5. A method generating quantized line spectral frequency signals from incoming speech samples when calculating parameters for an analysis filter included in a speech coder in the linear predictive coding of the incoming speech samples in order to synthesize said samples in a speech decoder subsequent to transmitting the line spectral frequency signals across a transmission channel with limited transmission capacity, wherein the line spectral frequency signals are formed by forming, based on the incoming speech samples, two mutually symmetrical polynomials with alternating roots on a unit circle for the analysis filter and quantizing the roots obtained from said two polynomials and corresponding to the line spectral frequencies, comprising:

a) storing, in a memory store, a number of quantizing levels which correspond to precalculated fixed line spectral frequencies, b) combining a given number of test frequencies derived from said quantizing levels into groups of test frequencies, each group corresponding to a possible root in each of said polynomials, c) scanning alternatingly on each of said polynomials by means of said given number of test frequencies, to establish the polarity of each of said polynomials, d) for each of said polynomials, evaluate a given root by using the test frequency values belonging to a given group to determine two consecutive frequency values for which a change in polarity for one and the same polynomial has occurred, and e) determining the quantizing level which corresponds to the value between said two consecutive test frequency values, thus determining the positions of the roots of each polynomial and the specific quantized lines spectral frequency signals.

6. A method as claimed in claim 5, wherein said determining of the quantizing level implies choosing a quantizing level which is situated midway between said two consecutive test frequency values.

7. A method as claimed in claim 6, wherein in step e) choosing the largest quantizing level as a measure of the root of an examined polynomial when a polarity change of said examined polynomial occurs for the largest test frequency value in a given group of test frequency values.

8. A method as claimed in claim 6, wherein in step d) taking into account when evaluating a second root which next follows a first root of the same polynomial, the fact that the second root can be misinterpreted as said first root, and therefor ignoring the first occurring test frequency value for polarity change when evaluating said second root.

9. A method as claimed in claim 5, wherein in step e) choosing the largest quantizing level as a measure of the root of an examined polynomial when a polarity change of said examined polynomial occurs for the largest test frequency value in a given group of test frequency values.

10. A method as claimed in claim 5, wherein in step d) taking into account when evaluating a second root which next follows a first root of the same polynomial, the fact that the second root can be misinterpreted as said first root, and therefor ignoring the first occurring test frequency value for polarity change when evaluating said second root.

* * * * *